US010099222B2

(12) United States Patent
Weinmann et al.

(10) Patent No.: US 10,099,222 B2
(45) Date of Patent: Oct. 16, 2018

(54) METHOD AND DEVICE FOR PRODUCING FLOUR AND/OR SEMOLINA

(75) Inventors: Stephen Weinmann, Degersheim (CH); Daniel Rickenbach, Eschlikon (CH); Marcos Luquin, Constance (DE)

(73) Assignee: Bühler AG, Uzwil (CH)

( * ) Notice: Subject to any disclaimer, the term of this patent is extended or adjusted under 35 U.S.C. 154(b) by 1120 days.

(21) Appl. No.: 14/130,055

(22) PCT Filed: Jul. 2, 2012

(86) PCT No.: PCT/EP2012/062835

§ 371 (c)(1),
(2), (4) Date: Apr. 14, 2014

(87) PCT Pub. No.: WO2013/001093

PCT Pub. Date: Jan. 3, 2013

(65) Prior Publication Data

US 2014/0252141 A1 Sep. 11, 2014

(30) Foreign Application Priority Data

Jun. 30, 2011 (EP) ..... 11172061

(51) Int. Cl.
*B02C 4/00* (2006.01)
*B02C 4/06* (2006.01)
(Continued)

(52) U.S. Cl.
CPC ..... *B02C 4/06* (2013.01); *B02C 4/08* (2013.01); *B02C 4/30* (2013.01); *B02C 4/38* (2013.01)

(58) Field of Classification Search
CPC ..... B02C 4/06; B02C 4/38
(Continued)

(56) References Cited

U.S. PATENT DOCUMENTS 1,360,499 A * 11/1920 Clark ..... B02C 4/30 241/235
1,743,623 A * 1/1930 Ross ..... B44B 3/04 241/235
(Continued)

FOREIGN PATENT DOCUMENTS

DE 1757093 3/1971
DE 102007032261 1/2009
(Continued)

OTHER PUBLICATIONS

Lynch et al., "The History of Grinding", 2005, 5 pages, Society for Mining, Metallurgy, and Exploration, Inc., Littleton, Colorado.

*Primary Examiner* — Faye Francis
(74) *Attorney, Agent, or Firm* — Davis & Bujold PLLC; Michael J. Bujold

(57) ABSTRACT

To produce flour and/or semolina, raw material is fed into a feed opening of a roller press. The milling gap of the roller press is fixed, or damping of at least one of the rollers with respect to the lateral deflection is set, such that a first subset of the fill containing finer milling material forms a packed particle fill in the milling gap. In addition, the setting is carried out in such a way that individual particles of a second subset of the fill containing coarser milling material are in contact with the first roller and the second roller of the roller press. Subsequently, the bulk material is milled into milled product in the roller press (9) and the milled product is discharged through a discharge opening.

6 Claims, 8 Drawing Sheets

Figure 1:
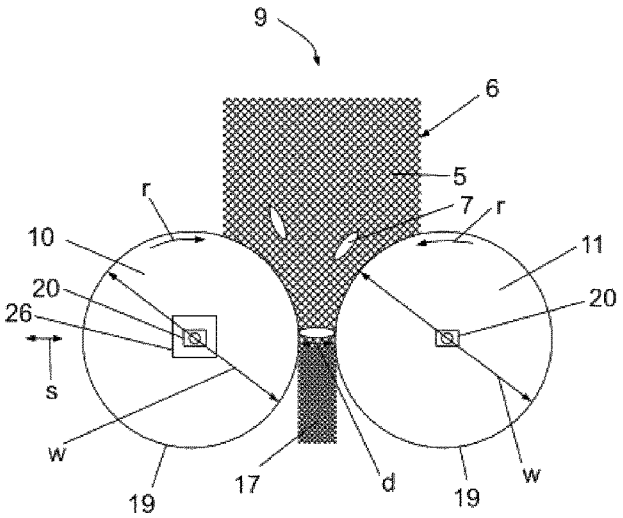

(51) Int. Cl.
*B02C 4/08* (2006.01)
*B02C 4/30* (2006.01)
*B02C 4/38* (2006.01)

(58) Field of Classification Search
USPC ..... 241/6–10, 294, 286
See application file for complete search history.

(56) References Cited

U.S. PATENT DOCUMENTS 2,255,226 A * 9/1941 Bourdin ..... B02C 4/30 209/700
3,261,741 A * 7/1966 Bidwell ..... D21B 1/063 162/261
3,313,015 A 4/1967 Spangier
RE28,581 E 10/1975 Koppern
4,089,478 A * 5/1978 Collie ..... B02C 4/06 241/167
4,357,287 A 11/1982 Schönert
4,608,007 A * 8/1986 Wood ..... B02C 4/32 100/907
4,703,897 A 11/1987 Beisner et al.
5,372,315 A 12/1994 Kranz et al.
5,417,374 A * 5/1995 Kranz ..... B02C 4/286 241/18
6,634,577 B2 * 10/2003 Horigane ..... B02C 4/06 241/235
7,588,206 B2 * 9/2009 Hausman ..... B02C 4/08 241/101.2
8,282,029 B2 * 10/2012 Maaren ..... A22C 17/06 241/101.2
2013/0320120 A1 * 12/2013 Assmann ..... B02C 4/42 241/30
2014/0239100 A1 * 8/2014 Felix ..... B02C 4/286 241/26

FOREIGN PATENT DOCUMENTS

| | | | |
|---|---|---|---|
| DE | 202009011811 | | 11/2009 |
| EP | 0137496 | | 4/1985 |
| EP | 0335925 | | 10/1989 |
| EP | 0399192 | | 11/1990 |
| EP | 0405518 | | 1/1991 |
| FR | 471467 | | 10/1914 |
| JP | H09168747 | A | 6/1997 |
| JP | 2006102564 | A | 4/2006 |
| JP | 2007167730 | A | 7/2007 |
| JP | 2008272712 | A | 11/2008 |
| JP | 2011-526538 | | 10/2011 |
| WO | 2010/000811 | | 1/2010 |
| WO | 2011/048226 | | 4/2011 |

* cited by examiner

METHOD AND DEVICE FOR PRODUCING FLOUR AND/OR SEMOLINA

The present invention relates to a method for producing flour and/or semolina as well as to a high-pressure roller mill and the use thereof as claimed in the preambles of the independent claims.

Methods and devices for producing flour and/or semolina are known per se. For example, a method and a device for producing milled cereal products such as, for example, flour, semolina or middlings according to the principle of high-performance milling are known from EP 0 335 925 B1. Here, the material to be milled is roll-milled many times and repeatedly sieved. In this case, a material to be milled is directed over double roller milling steps, the material to be milled being directed over at least two milling steps of this type, being directed between the individual steps without any sieving and being sifted in each case following the double milling.

However, the disadvantage of these types of devices is that expenditure on equipment is very high as a result of the necessity for several milling steps, which is costly. In addition, the use of several milling installations leads to large buildings being necessary for the mill, which increases the costs for setting up a mill even further.

DE 1 757 093 A1 makes known a roller mill for fine grinding brittle material, a roll gap width which is greater than the grain size of the substantial part of the material to be fed being set in dependence on the object of the material and on a pressing force of the roller necessary for comminution.

WO 2010/000811 A1 makes known a method for producing flour and/or semolina where a high-pressure roller mill with a variable gap is used. The roll gap is set, in this case, in dependence on the amount and the type of cereal to be milled as well as on the set pressure which is exerted on the rollers in the direction of the roll gap.

However, the disadvantage of said previously known method as well as of the corresponding device, in this case, is that larger particles in the material to be milled are not reliably milled and, as a result of the material to be milled which is to be processed and often also includes particles of approximately the size of the roll gap, the rollers can start to vibrate. In addition, in the case of high-pressure roller mills of this type, heat is rarely input into the material to be milled, which is, however, desired in the production of certain sorts of flour.

Consequently, it is the object of the present invention to avoid the disadvantages of what is known, in particular therefore to provide a method and a device by way of which flour can be produced in a reliable manner from a material to be milled containing finer and coarser materials to be milled. A further object of the present invention is additionally providing a device and a method by way of which flour can be produced from material in a cost-efficient and energy-saving manner, in particular with sufficient heat also being supplied into the flour during milling.

Said objects are achieved by a method and a device as claimed in the independent claims.

The method according to the invention for producing flour and/or semolina from material, in particular cereals, cocoa, sunflower seeds and rice or from arbitrary combinations thereof, in this case, includes the following steps: Material is supplied from a fill into a feed opening of a high-pressure roller mill. The high-pressure roller mill includes a first roller and a second roller, wherein, to set a milling gap between the two rollers, at least one of the two rollers is mounted so as to be movable in a direction substantially perpendicular to the direction of rotation of either of the two rollers. In addition, damping with reference to a deflection in the direction of the roller, in which the roller is movable mounted, can be set and/or the milling gap can be set in a fixed manner. The fill consists of particles with a size distribution and includes, in particular, one of the following types or mixtures thereof: material, semolina or hull parts. In a further step, which can also be carried out prior to the above step, the milling gap is fixed or the damping is set such that a first part amount of the fill containing finer material to be milled forms a packed particle fill in the milling gap. In addition, the setting is undertaken in such a manner that individual particles of a second part amount of the fill containing coarser milling material are in contact with the first roller and the second roller of the high-pressure roller mill. The bulk material is then milled in the high-pressure roller mill into milled product. Following the milling, the milled product is removed through an outlet opening.

In terms of the present application, cereals, cocoa, sunflower seeds and rice or arbitrary combinations thereof are understood as the material.

In the method according to the invention, bread wheat, durum wheat, maize and buckwheat or arbitrary combinations thereof are used in a preferred manner as cereals.

In particular, pressure onto the rollers in the direction of the milling gap is pre-set and/or settable, for example in conjunction with the damping.

A high-pressure roller mill in terms of the present application is to be understood as a roller mill of this type where a material bed is created in the drawing-in region between the rollers when the high-pressure roller mill, as a result of an oversupply of material, for example by means of a filled material chute or funnel, is able to draw in said material. The material bed comminution for the finer material to be milled is based, in this case, on a packed particle fill in the milling gap.

A direction of rotation in terms of the present application refers in the mathematical sense to the vector which stands perpendicular on the rotational plane.

Damping with reference to a deflection in the direction in which the roller is movably mounted is to be understood in terms of the present application as damping to suppress oscillations, as is possible for example with shock absorbers or adjustable hydraulic and/or pneumatic damping, hydraulic damping being preferably used.

The use of adjustable damping of this type with reference to the deflection is advantageous in particular when a force-controlled roller mill is used where, for example, mechanically pre-tensioned springs or hydraulically coupled gas pressure accumulators are used to generate force and pressure is exerted onto the rollers in the direction of the milling gap. In the case of such a development, a milling gap is then formed between said rollers in dependence on the amount and the type of the material to be milled in the milling gap as well as on the pressure set. As a result of oscillations in the composition of the material to be milled or even as a result of a certain proportion of coarser material to be milled which is in contact with both rollers, the high-pressure roller mill can, for example, be made to oscillate. Said oscillations can then be reduced or even completely suppressed using the adjustable damping.

When using a fixedly set milling gap, in a preferred manner damping is dispensed with since, in this case, the rollers are then locked with respect to one another and can consequently not be made to oscillate.

In terms of the present application, a size distribution of particles, in particular of material to be milled, is to be understood as the distribution of the largest dimension of the particles of the material to be milled.

A milling gap in terms of the present application is to be understood as the gap between the two rollers and in particular the smallest distance between rollers during the operation of the high-pressure roller mill, with purely the region of the rollers which is in contact with the material to be milled during operation when used as intended being taken into consideration for this purpose.

The advantage of the method according to the invention then is that the finer material to be milled is milled in a material bed situation and, in addition, the coarser material to be milled is also comminuted and in particular is acted upon strongly such that the coarser material to be milled is already strongly comminuted by means of a run through. As a result, the use of several milling steps is avoided to the greatest possible extent, the energy efficiency of the milling, in particular, also being as high as possible.

In a preferred manner, the first roller and the second roller rotate at different speeds. In particular, the ratio of speed is in excess of 1.1:1 and further in particular in excess of 2:1.

The advantage here is that the material to be milled is milled more efficiently as, in particular, greater shear forces occur in the material to be milled during operation at different speeds.

A further advantage is that the setting variables of the speed ratio, i.e. of the revolution ratio, of the rollers is an additional parameter for optimizing the milling process to produce flour and consequently the process is able to be better optimized. In addition, as a result, a lower pressure in the milling gap can be used as the milling is supported by the particularly larger shear forces as a result of the different speeds of the rollers. This leads to lower compression and consequently to better detachability for the further separation of the milled product after milling.

The speed at which a roller rotates refers in the sense of the present application to the speed of the roller surface in the tangential direction.

In a particularly preferred manner, at least one of the two rollers is realized as a profile roller. The profile roller has, in particular, a portionwise indentation in the roller surface, in particular substantially parallel to the longitudinal axis of the respective roller.

The surface which lies spaced radially furthest away from the longitudinal axis is to be understood as the roller surface in terms of the present application, with purely the part which is in contact with the material to be milled during operation when used as intended being taken into consideration for this purpose.

The advantage of this is that a small milling gap can be set for the reliable milling of the coarser material to be milled which is acted upon in a stronger manner as a result and is consequently milled in a stronger manner. A material bed situation, in which the smaller particles are also milled in a reliable manner in a packed particle fill, is formed in addition at least in the portion-wise indentations between the rollers.

In a more preferred manner, the profile of the profile roller is realized so as to be substantially self-cleaning, in particular at least during the rotation of the profile roller.

The term "self-cleaning" in the sense of the present application is to be understood by the fact that at least during the rotation, i.e. when the rollers are operating, material to be milled does not remain in the portion-wise indentations but falls out of them in a reliable manner and is able to be processed further in the devices connected downstream.

The advantage of said self-cleaning development of the portionwise indentations is that the drawing in of material to be milled into the high-pressure roller mill can be effected permanently in a reliable manner during operation, which is frequently not the case with non self-cleaning portionwise indentations.

The self-cleaning development of the portionwise indentations can be achieved as a result of the choice of the geometry of the portionwise indentations and/or as a result of the choice of the corresponding surface roughness.

In a preferred manner, following the milling of the material to be milled, the milled product is conveyed into a separating step for separation into finer milled product and coarser milled product. In particular, the coarser milled product is conveyed back into the feed opening.

These types of separating steps such as, for example, zigzag sifters, purifiers, plansifters, turbosifters, distributing plate sifters or even cross flow sifters, are known from the prior art, such as described, for example, in WO 2010/000811 A2.

Zigzag sifters separate, for example, product which is to be separated into finer product and coarser product as a result of the different specific weight and/or of the size of the particles in the product.

Plansifters separate, for example, product which is to be separated into finer product and coarser product by means of sieving substantially as a result of the size of the particles in the product.

The advantage of said separation of the milled product into finer and coarser milled product is that the respective fractions can be supplied to different intended applications. The advantage of conveying the coarser milled product back into the feed opening of the high-pressure roller mill is that the installation can be operated in cyclical mode and consequently the number of high-pressure roller mills or also other milling steps can be reduced, which results in cost savings and also energy savings.

In a particularly preferred manner, a further high-pressure roller mill is connected downstream of the separating step for further milling of the finer milled product.

The advantage of this is that the further high-pressure roller mill for the optimum milling of the finer milled product can have other process parameters such as, for example, the speed of the rollers or also the milling gap.

A further aspect of the present invention is directed towards a high-pressure roller mill for carrying out a method such as described above. Said high-pressure roller mill includes a first roller and a second roller, wherein at least one of the two rollers is realized as a profile roller with at least one portionwise indentation in the roller surface. Said portionwise indentation is, in particular, substantially parallel to the longitudinal axis of the profile roller. The portionwise indentation is self-cleaning at least when the profile roller is rotating.

As already explained above, the self-cleaning characteristic of the portionwise indentation is achieved as a result of the geometric development and/or as a result of the surface characteristics of the portionwise indentation.

The advantage of this as explained above is that even when using a profile roller, the material to be milled is permanently drawn into the milling gap in a reliable manner during operation.

The portionwise indentation preferably extends at least over the entire length of the profile roller which, when used as intended, is in contact with the material to be milled. In other words, the portionwise indentation is realized as a portionwise indentation in the circumferential direction.

In a preferred manner, at least one of the two rollers is mounted so as to be movable in a direction substantially perpendicular to the direction of rotation of one of the two rollers for setting a milling gap between the two rollers in operation. Damping can be set with reference to a deflection in the direction in which the roller is rotatably mounted and/or the milling gap can be set in a fixed manner.

In terms of the present application, setting the milling gap in a fixed manner means infinite damping as when the milling gap is set in a fixed manner, it is essentially not possible for the rollers to oscillate with respect to one another when used as intended.

In a particularly preferred manner, at least one portionwise indentation has on average a width in the circumferential direction of the profile roller within the range of between 0.5 mm and 20 mm. In particular, said width is on average within the range of between 2 mm and 10 mm and further in particular within the range of between 4 mm and 6 mm.

The average of the width in terms of the present application is to be understood as the mean of the width along the longitudinal direction, i.e. the longest extension of the portionwise indentation.

In a more preferred manner, the at least one portionwise indentation of the profile roller has on average a depth in the radial direction of the roller within the range of between 0.3 mm and 10 mm. In a preferred manner the depth is within the range of between 0.5 mm and 5 mm and in a particularly preferred manner between 0.7 mm and 1.8 mm.

In terms of the present application, the average of a depth of the portionwise indentation is to be understood as the mean of the deepest point along the largest extension of the portionwise indentation.

In a preferred manner, the roller surface with the at least one portionwise indentation of the profile roller, in a section between the roller surface and the face of the indentation which intersects the roller surface, encloses on average an inner angle of between 100° and 170°. In a preferred manner, the roller surface encloses an angle of between 120° and 150° with the at least one portionwise indentation and in a particularly preferred manner of between 130° and 140°.

An inner angle in terms of the present application is to be understood as an angle facing the longitudinal axis of the profile roller on the inner surface of the roller surface in a sectioned plane perpendicular to the longitudinal axis.

An average of an inner angle in terms of the present application is to be understood as a mean along a portion between the roller surface and the portionwise indentation.

The advantage of said development as described above with regard to one of the parameters of width, depth and inner angle or to combinations thereof is that the portionwise indentation is self-cleaning at least when the profile roller is rotating, as a result of which the operation is able to be effected over the long term in a reliable manner and in addition expensive cleaning devices which are costly, are not required.

In a particularly preferred manner, the profile roller has at least two portionwise indentations which are spaced apart from one another in the circumferential direction. Said portionwise indentations which are spaced apart from one another in the circumferential direction are at an average spacing within the range of between 0.15 mm and 10 mm, in a preferred manner between 0.15 mm and 5 mm and in a particularly preferred manner between 0.15 mm and 0.5 mm.

The average spacing between the portionwise indentations is to be understood as the average spacing along the longest extension of the portionwise indentation, the spacing between the two sides facing one another of the portionwise indentations being intended.

The advantage of said development with at least two portionwise indentations is that the milling of the coarser material to be milled can be effected in a reliable manner on the roller surface and a material bed situation can be created in the indentations to mill the finer material to be milled.

In a more preferred manner, the portionwise indentation of the profile roller has a flat face portion. In a preferred manner, said face portion is arranged substantially perpendicular to the radius of the profile roller.

A flat face portion in terms of the present application is to be understood as not being an arcuate or curved face portion, however even a face portion of this type with a usual surface roughness and/or with damage that usually occurs in operation such as, for example, scratches, counts as flat.

This has the advantage of further improving the self-cleaning of the portionwise indentation.

In a preferred manner, the first roller and/or the second roller of the high-pressure roller mill has a diameter within the range of between 400 mm and 1000 mm and in a preferred manner between 600 mm and 800 mm.

The advantage of said diameter which is large compared to conventional cylinder mills is that the drawing in of the product is improved.

A further aspect of the present invention is directed towards the use of a high-pressure roller mill as described above for producing flours and/or semolinas from cereals, cocoa, sunflower seeds and rice or from arbitrary combinations thereof according to the above-described method.

Said use has the above-described advantages.

An additional aspect of the present invention is directed towards a high-pressure roller mill with a first roller and a second roller, wherein at least one of the two rollers is mounted so as to be movable in a direction substantially perpendicular to the direction of rotation of one of the two rollers for setting a milling gap between the two rollers, and wherein damping with reference to a deflection in the direction in which the roller is movably mounted can be set and/or the milling gap can be set in a fixed manner.

The alternative high-pressure roller mill can be combined in particular with the embodiments disclosed in relation to said high-pressure roller mill.

A further aspect of the present invention relates to a surface segment for forming an in particular profiled roller surface of a roller. In particular, a roller for a high-pressure roller mill as described above is formed. The surface segment is releasably fastenable on a roller body by means of a fastening means for forming the roller. In the circumferential direction of the roller body, the surface segment covers an angular region of between 22° and 90°, in a preferred manner between 30° and 45° and in a particularly preferred manner between 32° and 40°.

The advantage of the modular design of the roller from a roller body and surface segments is that the surface segments serve as wearing parts which are replaceable in a cost-efficient manner with little expense of effort. In addition, the advantage of the surface segments is that the angular region covered by the surface segments can be chosen in dependence on the diameter of the roller body such that, as a result of their corresponding size, the surface segments are simple to handle and are not too heavy.

In particular, the roller including the surface segments and the roller body can be used as the first roller and/or the second roller in a high-pressure roller mill as described above.

In a preferred manner, the cross section of the surface segment is realized substantially in the form of a ring segment.

The cross section through a surface segment is to be understood in the present case as the section being effected perpendicular to the longitudinal axis of the roller when the surface segment is used as intended.

The advantage of ring-segment-shaped surface segments is that less material is used for producing the surface segments, which makes the surface segments more cost-efficient and lighter, which facilitates handling in particular during assembly or disassembly.

In a particularly preferred manner, the surface segment can be operatively connected to a torque transmitting device in such a manner that torque can be transmitted from the roller body to the surface segment.

A "torque transmitting device" in terms of the present application is to be understood as such a device which can transmit the torque exerted on the roller body in operation in a reliable manner onto the surface segments to drive the roller such that in operation the surface segments are not detached in an unwanted manner from the roller body as a result of the forces that occur in operation. The surface segments are usually fastened on the roller body by way of fastening means which are realized as screws, the screws, however, possibly not being able to be realized in a sufficiently sturdy manner such that when large shear forces occur in operation surface segments can be detached, which is to be avoided; an additional torque transmitting device results in such a case in a more reliable and consequently more cost-efficient operation.

In a more preferred manner, on the side facing the roller body, the surface segment has a surface segment groove for engagement for the torque transmitting device.

The advantage of this is that as a result of the engagement of the torque transmitting device in the surface segment groove a reliable transmission of torque is enabled from the roller body to the surface segment as the surface for the operative connection between the roller body and the surface segment is enlarged for the torque transmission, which avoids overloads and consequently makes the operation more reliable.

In a particularly preferred manner, the surface segment groove extends substantially parallel to the longitudinal axis of the roller when used as intended.

The advantage of this is further reduction of point-focal peak loads on the surface segment, as a result of which the operation becomes yet more reliable.

An additional aspect of the present invention relates to a set comprising surface segments as described above for forming a closed roller surface of a roller. The set includes 4 to 16 surface segments, in a preferred manner 8 to 12 surface segments, in a particularly preferred manner 9 to 11 surface segments and in a more preferred manner 10 surface segments.

Forming a "closed" roller surface of a roller in terms of the present application is to be understood as a surface which is realized substantially in the circumferential direction without interruption in the roller surface. In other words, therefore, the roller body is completely covered by surface segments in the region of the roller which comes into contact with the material when used as intended.

In a preferred manner, the set includes one torque-transmitting device between the roller body and the surface segment. In particular, the set includes the same number of torque transmitting devices as surface segments. In addition, in particular, the torque transmitting device is realized as a bar for engaging in a surface segment groove of the surface segment, wherein in a preferred manner the bar is realized in cross section at least in portions in an angular manner and in particular in a wedge-shaped manner or a rectangular manner.

A further aspect of the present invention relates to a roller including at least one surface segment as described above and one roller body. The surface segment is fastened detachably on the roller body by means of a fastening means. The roller includes a torque transmitting device for transmitting torque from the roller body to the surface segment.

In a preferred manner the roller body has a roller groove in which the torque transmitting device is releasably fastenable.

The advantage of this is the reliable transmission of torque from the roller body to the torque transmitting device avoiding the creation of point-focal peak loads, which makes the operation of the roller more reliable.

In a particularly preferred manner, the torque transmitting device is realized as a bar for engaging at the same time in the roller groove and a surface segment groove of the surface segment.

In a more preferred manner, the bar is realized in cross section at least in portions in an angular manner and in a preferred manner in a wedge-shaped manner or a rectangular manner.

The advantage of this is the particularly reliable transmission of torque from the roller body to the bar and from the bar to the surface segment, in the surface segment groove in which the bar engages.

The term "angular" in terms of the present application is to be understood as the bar in cross section having at least one right angle, one acute angle or one obtuse angle or arbitrary combinations thereof.

In a preferred manner, the roller body includes a balancing device.

The advantage of this is that an asymmetrical weight distribution with reference to the longitudinal axis of the roller body, about which the roller rotates in operation, can result in too high bearing loads or oscillations which can be balanced out by means of the balancing device. As a result, therefore, the operation is more reliable with less wear, which reduces the costs.

In a particularly preferred manner, the balancing device is realized as a recess, which is arranged at least in portions in the roller body. The recess is realized in particular as a bore. The recess is arranged substantially parallel to the longitudinal axis of the roller body, wherein at least one balance weight can be inserted into the recess. In particular, the balance weight is produced from lead.

In particular, the roller has recesses which are spaced apart from one another in the circumferential direction in such a manner that corresponding balance weights can be inserted into the respective recesses to balance out the roller.

Figure 2:
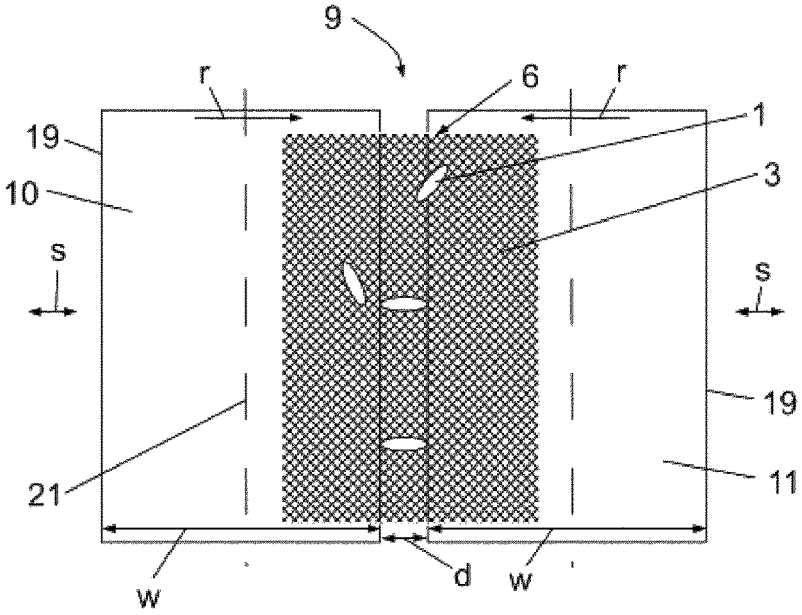
Figure 3:
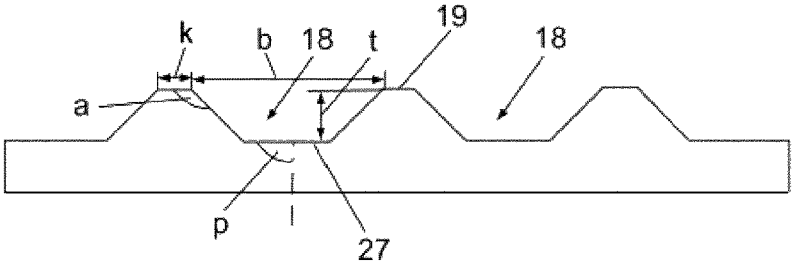
Figure 4:
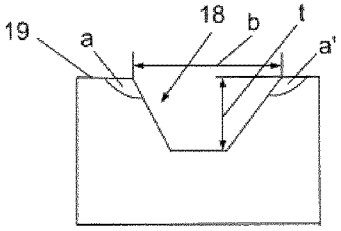
Figure 5:
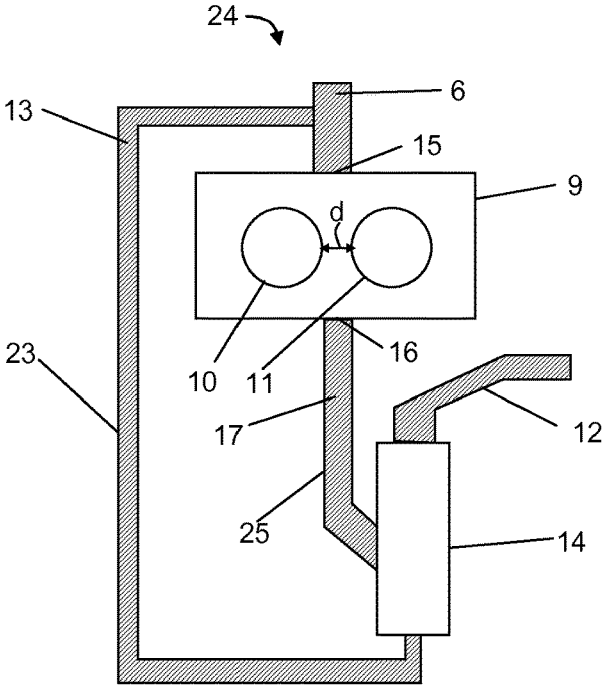
Figure 6:
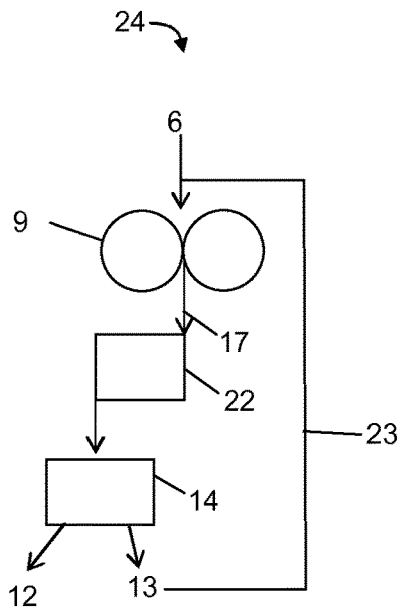
Figure 7:
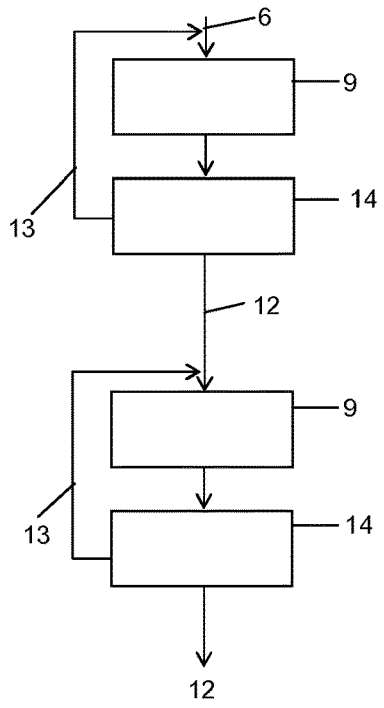
Figure 8:
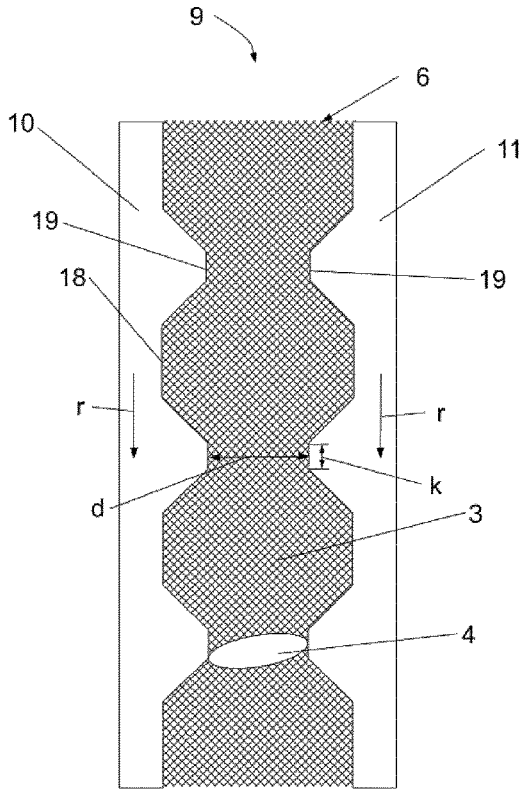
Figure 9:
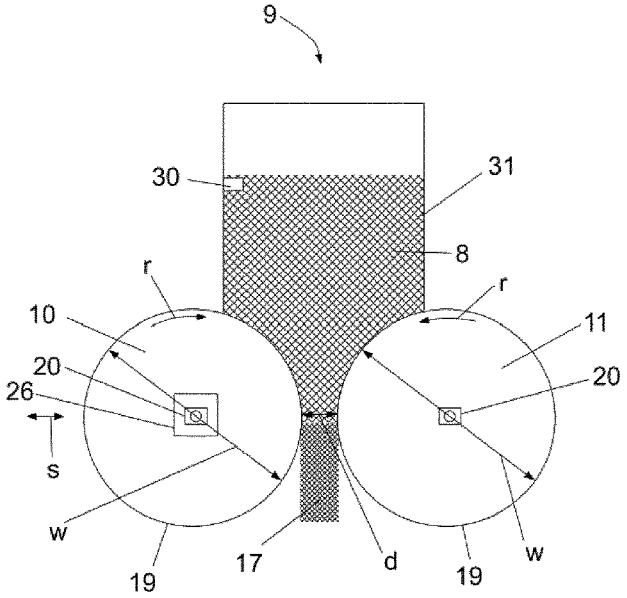
Figure 10:
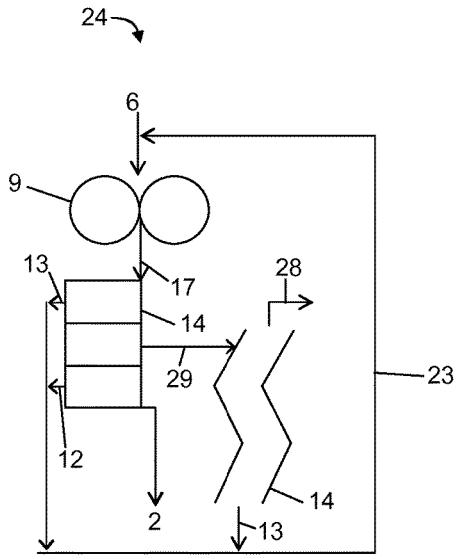
Figure 11:
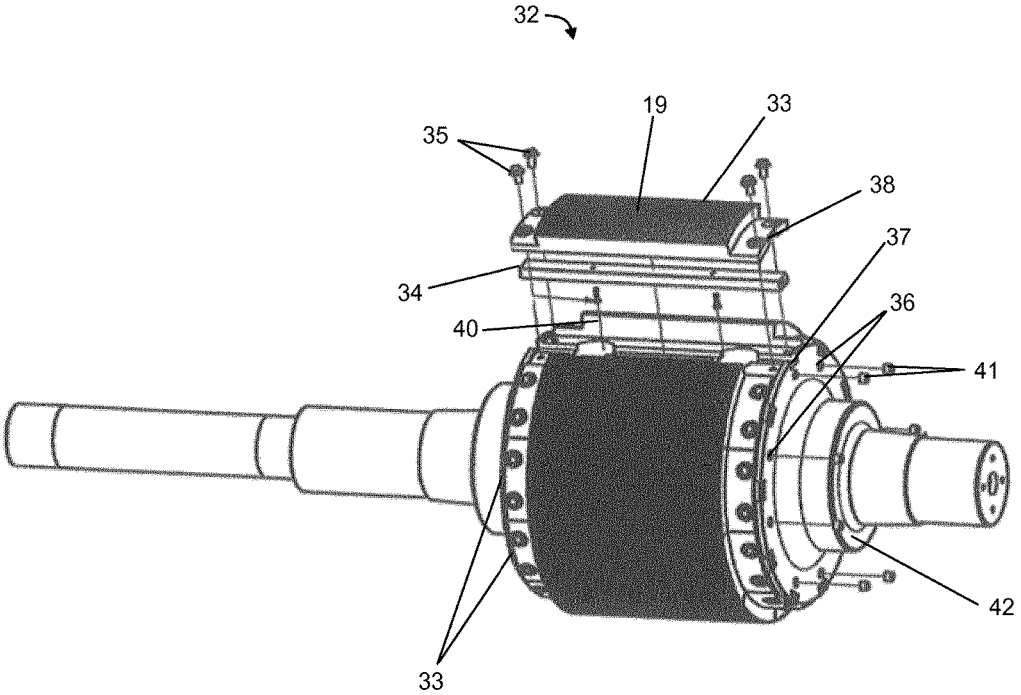
Figure 12:
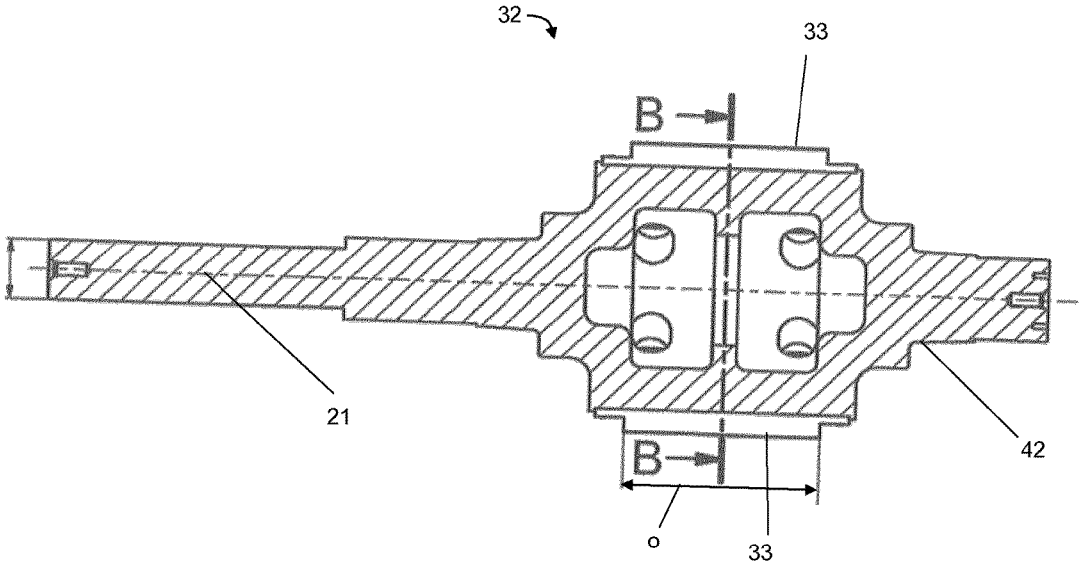
Figure 13:
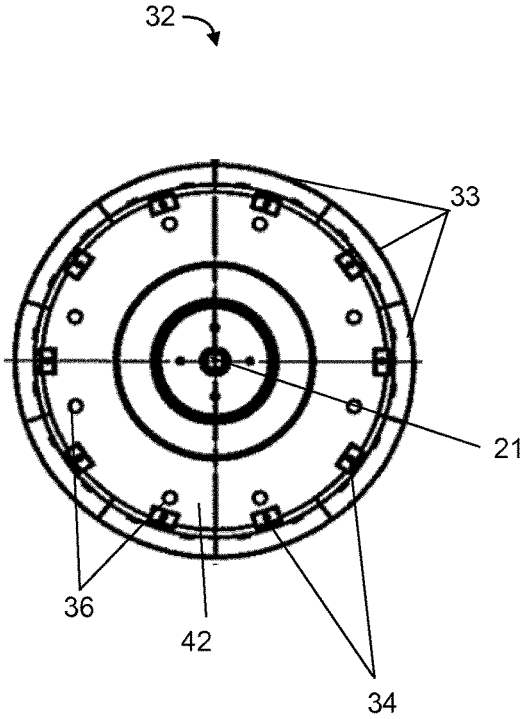
Figure 14:
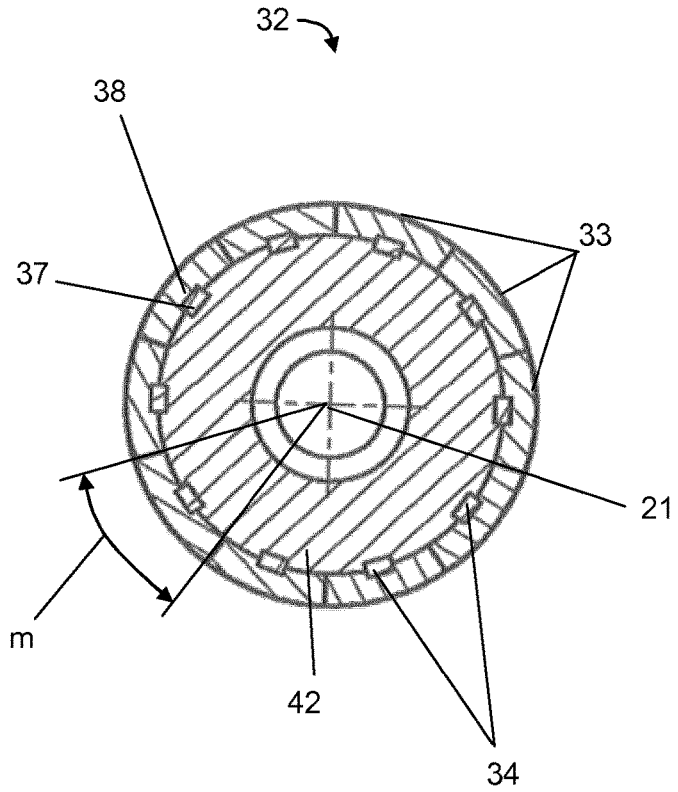
Figure 15:
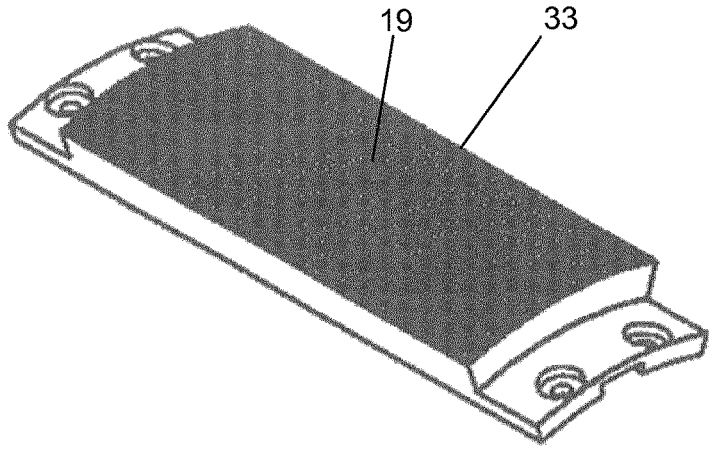
Figure 16:
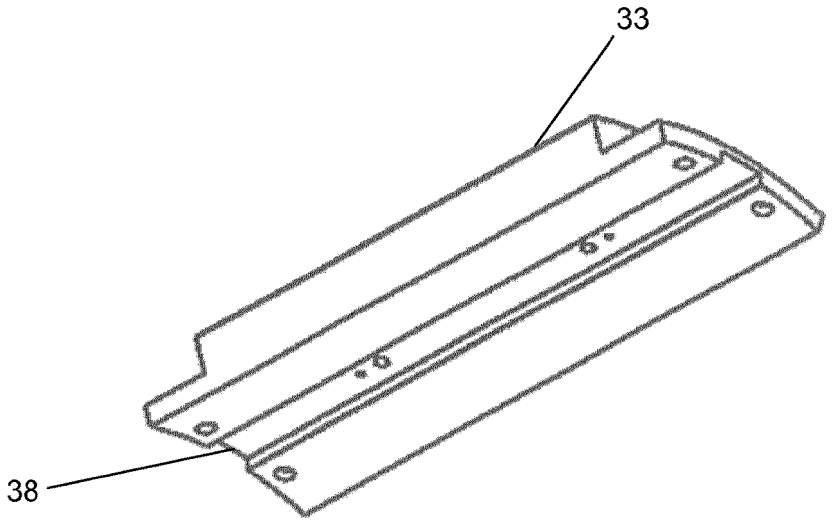

For increased understanding, further features and advantages of the invention are explained in more detail below by way of exemplary embodiments without the invention being restricted to the exemplary embodiments, in which:

FIG. 1: shows a schematic side view of a high-pressure roller mill according to the invention with bulk material;

FIG. 2: shows a schematic top view of an alternative high-pressure roller mill according to the invention with bulk material;

FIG. 3: shows a schematic representation of a profile according to the invention of a profile roller;

FIG. 4: shows a schematic representation of an alternative profile of a profile roller according to the invention;

FIG. 5: shows a schematic representation of a high-pressure roller mill according to the invention with a separating step and product feed;

FIG. 6: shows an alternative arrangement of a high-pressure roller mill according to the invention with detacher, separating step and product return;

FIG. 7: shows a flow diagram of a method according to the invention using two high-pressure roller mills;

FIG. 8: shows a schematic representation of an enlarged detail of a high-pressure roller mill according to the invention with two profile rollers and bulk material;

FIG. 9: shows a schematic side view of an alternative high-pressure roller mill according to the invention with a level sensor in the feed funnel;

FIG. 10: shows an arrangement of a high-pressure roller mill according to the invention with several separating steps;

FIG. 11: shows a partially exploded view of a perspective representation of a roller according to the invention consisting of a roller body and surface segments;

FIG. 12: shows a section along the longitudinal axis through a roller according to the invention according to FIG. 11;

FIG. 13: shows a front view parallel to the longitudinal axis of the roller according to the invention according to FIG. 11;

FIG. 14: shows a sectioned representation of a roller according to the invention according to FIG. 12 along the sectional plane B;

FIG. 15: shows a perspective representation of a surface segment with the roller surface visible;

FIG. 16: shows a perspective representation of the surface segment according to FIG. 15 from below.

FIG. 1 shows a schematic side view of a high-pressure roller mill 9. A fill 6 includes finer product to be milled 5 as well as coarser product to be milled 7 which is drawn into the milling gap d as a result of the rotation in the direction r of the two rollers 10 and 11.

The roller 10 is mounted so as to be movable in the direction s, i.e. perpendicular to the direction of rotation, as a result of which a milling gap d can be set. The rollers 10 and 11 both have a diameter w of 600 mm and are mounted by means of the bearing 20 to rotate in the direction r. The rollers have a smooth roller surface 19. To avoid oscillations, the bearing 20 has a damping device 26 which is realized as pneumatic damping.

The milling gap d, in the present case, is variable in dependence on the bulk material 6 drawn in, pressure acting in the direction of the milling gap d is set by the rollers 10 and 11 such that the finer material to be milled 5 is milled in the milling gap d by means of a packed particle fill and the coarser material to be milled 7 is comminuted in the milling gap d as a result of direct contact with the rollers 10 and 11. The high-pressure roller mill 9, in this case, has the damping device 26 which is known per se to the person skilled in the art in order to avoid the generation of oscillations of the rollers with respect to one another.

The roller 10 has a circumferential speed of 1 m/s and the roller 11 has a circumferential speed of 1.5 m/s. The speed ratio between the rollers 10 and 11, in this case, is 1.5:1.

In operation, bulk material 6, comprising finer material to be milled 5 and coarser material to be milled 7, is drawn into the high-pressure roller mill 9 as a result of the rollers rotating in the direction r. With reference to the finer material to be milled, a packed particle fill is formed between the two rollers in the milling gap d, which here is set to a value of 1 mm, as a result of which the finer material to be milled is milled.

The coarser material to be milled 7 touches the first roller 10 and the second roller 11 at least in the region of the milling gap d such that said coarser material to be milled is strongly comminuted.

After the milling, the milled product 17 which, for example, can be flour, is then removed from the high-pressure roller mill.

FIG. 2 shows a schematic representation of a top view onto a high-pressure roller mill 9 substantially according to FIG. 1.

From this point on and below, the same references refer to the same components in the figures.

In contrast to the high-pressure roller mill 9 according to FIG. 1, in this case the two rollers are mounted so as to be movable in the direction s. During operation for milling, the rollers are rotatable about the longitudinal axis 21 by means of the bearings (not shown here), both of which include a damping device (not shown here) which is realized as a shock absorber.

In contrast to FIG. 1, the milling gap d here is set in a fixed manner during operation to a value of 1 mm. In the present case, cereal 1 is milled as the coarser material to be milled and semolina 3 as the finer material to be milled.

The roller 10, in the present case, has a circumferential speed of 0.8 m/s and the roller 11 a circumferential speed of 2.4 m/s. Consequently, there is a speed ratio of 3:1.

A further difference to FIG. 1 is that the roller 10 in the present case is realized as a profile roller with a profile which is not shown here.

FIG. 3 shows a schematic representation of a detail of a profile of a roller.

The profile has two completely shown, portionwise indentations 18 with an average depth t of 1.2 mm, the portionwise indentations 18 having a flat face portion 27 perpendicular to the radius of the profile roller. The flat face portion 27 therefore encloses an angle p=90° with the radius of the roller which is indicated as a broken line. A width b of the indentation 18 is 4.3 mm and a spacing k between the portionwise indentations on the roller surface 19 is 0.2 mm. The inner angle a is 135°. On both sides of the portionwise indentations 18 with reference to FIG. 3, the roller has further portionwise indentations which are not shown here.

FIG. 4 shows an alternative profile of a profile roller as a detail. The profile roller has an indentation 18 with a width b of 7 mm and a depth t of 1.8 mm. In contrast to FIG. 3, the portionwise indentation 18 is not realized in a symmetrical manner and on the one side in the circumferential direction has an angle a of 120° and on the other side in the circumferential direction an angle a' of 140°.

FIG. 5 shows in a schematic manner an installation 24 comprising a high-pressure roller mill 9 with two rollers 10 and 11. The rollers 10 and 11, which are both developed as profile rollers with a profile according to FIG. 3, are set to a fixed milling gap d of 0.1 mm. The high-pressure roller mill 9 has a feed opening 15 for the bulk material 6, in this case rice, and an outlet opening 16 for the milled product 17. The milled product 17 is conveyed by means of a conveyor arrangement 25 into a separating step 14 which in this case is realized as a zigzag sifter. In the zigzag sifter, the milled product 17 is separated into finer milled product 12 and coarser milled product 13. Said separation is effected substantially as a result of the physical characteristics of the particles such as, for example, the size, the suspension characteristics and the specific weight or combinations of said characteristics. The coarser milled product 13 is conveyed back into the feed opening 15 of the high-pressure roller mill 9 by means of a return arrangement 23. Finer milled product 12 is removed out of the arrangement 24, in this case as flour.

FIG. 6 shows a further arrangement 24 according to the invention which has a plansifter as the separating step 14 and, in addition, a detacher 22 between the high-pressure roller mill 9 and the separating step 14. The detacher 22 is realized as an impact detacher, as is known to the person skilled in the art, for example from WO 2010/000811 A1. Cocoa is used as the bulk material 6 in this case.

FIG. 7 shows a flow diagram of a method according to the invention. Bulk material 6, in this case sunflower seeds, is supplied to a high-pressure roller mill 9 and is milled in said roller mill. The milled product is supplied to a separating step 14 in which the milled product is separated into finer milled product 12 and coarser milled product 13. The coarser milled product 13 is conveyed back into the high-pressure roller mill 9.

The finer milled product 12, in the present case, is supplied to a further high-pressure roller mill 9, a further separating step 14 being connected downstream of said further high-pressure roller mill. In said further separating step, the milled product from the further high-pressure roller mill 9 is once again separated into finer milled product 12 and coarser milled product 13, the coarser milled product 13 once again being conveyed back into the further high-pressure roller mill 9. The finer milled product 12 can now be processed further as flour.

FIG. 8 shows a schematic representation of details of a high-pressure roller mill 9. The first roller 10 and the second roller 11 are realized in each case with profiles according to FIG. 3. The rollers rotate in the direction of rotation r, the roller 10 having a circumferential speed of 3 m/s and the roller 11 a circumferential speed of 0.5 m/s, i.e. the rollers have a speed ratio of 6:1.

A milling gap d is set in a fixed manner to a value of 0.8 mm, no damping device being provided. The spacing k is 0.3 mm.

The bulk material 6 includes semolina as the finer milled product and hull parts 4 as well as cereal (not shown here) as the coarser milled product, which is milled as described in regard to FIG. 1.

FIG. 9 shows a high-pressure roller mill 9 according to FIG. 1. Material to be milled 8, which forms a fill, is situated in a feed funnel 31. A supply of material to be milled 8 into the feed funnel 31 is not shown here.

The feed funnel 31 includes a level sensor 30 for measuring the level of material to be milled 8 in the feed funnel 31. The circumferential speed of at least one of the rollers 10 or 11 can be set, for example, as a result of the measured level of material to be milled 8 in the feed funnel 31.

If, for example, the level of material to be milled 8 falls below a predetermined value, it is possible to increase the level of material to be milled 8 in the feed funnel 31 by reducing the circumferential speed of at least one of the rollers 10 or 11 since, as a result of said measure, the flow rate through the high-pressure roller mill 9 is reduced, whilst material to be milled 8 continues to be supplied into the feed funnel 31.

By increasing the circumferential speed of at least one of the rollers 10 or 11, the level of material to be milled 8 in the feed funnel 31 can be reduced since, as a result of said measure, the flow rate through the high-pressure roller mill 9 is increased, whilst material to be milled 8 continues to be supplied into the feed funnel 31.

As a result of measuring using the level sensor 30, it is also possible to control the supply of material to be milled 8 into the feed funnel 31 in order to increase or reduce the level in the feed funnel 31 at a constant flow rate through the high-pressure roller mill 9.

A difference to FIG. 1 is that the rollers 10 and 11 are realized as profile rollers with a profile which is not shown in this case.

FIG. 10 shows a further alternative arrangement 24 according to the invention which has a plansifter and a zigzag sifter as separating steps 14.

A fill 6, in this case a mixture of rice and cereals, of material to be milled is situated above a high-pressure roller mill 9. The material to be milled is milled in the high-pressure roller mill 9 into milled product which is then conveyed into the plansifter.

In the plansifter the milled product is separated into a finer milled product 12, an average milled product 29 and a coarser milled product 13. In addition, a further fraction is removed from the plansifter as flour 2. The average milled product 29 is conveyed into a further separating step 14 which, in this case, is realized as a zigzag sifter. In the zigzag sifter the average milled product 29 is separated into finer milled product and coarser milled product 13, the zigzag sifter being set such that the finer milled product essentially includes bran 28. The mass fraction of bran 28 in the material to be milled is within the range of between 1% by weight and 10% by weight and in particular within the range of 3% by weight and 5% by weight with reference to the material to be milled.

The finer milled product 12 and the coarser milled product 13 from the plansifter as well as the coarser milled product 13 from the zigzag sifter are conveyed back into the high-pressure roller mill 9 by means of the return arrangement 23.

FIG. 11 shows a partially exploded view of a perspective representation of a roller 32 according to the invention consisting of a roller body 42 and several surface segments 33. The surface segments 33 have a roller surface 19 on the side remote from the roller body 42.

The roller 32 has a balancing device 36 which is formed by several bores substantially parallel to the longitudinal axis of the roller 32. Balance weights of lead (not shown here) can be inserted into the bores, the bores being closable by means of closure caps 41 once the balance weights have been inserted.

The roller body 42 has a roller groove 37 into which a torque transmitting device 34 which is realized as a bar is insertable. The bar is releasably fastenable in the roller groove 37 by means of a transmitting fastening device 40 realized as screws. The bar, in this case, is realized such that it projects out of the roller groove 37 in the radial direction once it has been inserted into the roller groove 37.

On the side facing the roller body 42, the surface segments 33 have a surface segment groove 38 in which the bar, that is the torque transmitting device 34, is able to engage. In addition, fastening means 35 realized as screws are provided, by means of which the surface segment can be releasably connected to the roller body 42. In the mounted state, the bar engages in the surface segment groove 38, as a result of which reliable torque transmission is ensured during operation from the roller body 42 to the surface segment 33.

FIG. 12 shows a sectioned representation of the roller 32 according to the invention according to FIG. 11 parallel to the longitudinal axis. A segment length o of the surface segments 33 is approximately 400 mm.

FIG. 13 shows a front view of the roller 32 according to the invention according to FIG. 11 parallel to the longitudinal axis 21.

The roller 32 includes 10 surface segments 33. The torque transmitting device 34, which is realized as a bar, is received in the region formed by the surface segment groove and the roller groove.

FIG. 14 shows a sectioned representation of the roller 32 according to the invention parallel to the axis B according to FIG. 12.

The roller 32 includes 10 surface segments 33 which, in each case, cover an angular range m of 36°. The surface segments 33 are releasably connected to the roller body 42, a rectangular bar as torque transmitting device 34 being received in the region formed by the roller groove 37 and the surface segment groove 38.

FIG. 15 shows a perspective representation of a surface segment 33 with the roller surface 19. FIG. 16 shows a further perspective from below of the surface segment 33 according to FIG. 15, in which the surface segment groove 38 can be seen.

The invention claimed is:

1. A milling method for producing a milled product consisting of at least one of flour and semolina from a material selected from the group of materials consisting of cereals, cocoa, sunflower seeds and rice or combinations thereof, said method including the following steps:

providing a high-pressure roller mill comprising:

a feed opening and an outlet opening, a first roller and a second roller, wherein at least one of the first and the second rollers is mounted so as to be movable in a direction substantially perpendicular to a direction of rotation of the other of the first and the second rollers, such that a milling gap may be set between the first and the second rollers, providing a bulk supply of the material consisting of particles with a size distribution, wherein a first partial amount of the bulk supply of the material consists of finer material to be milled and a second partial amount of the bulk supply of the material consists of coarser material to be milled;

setting the milling gap in such a manner that, during operation, the first roller and the second roller do not oscillate with respect to one another, wherein the milling gap is set larger than particle sizes of the first partial amount of the bulk supply of the material, and the milling gap is set smaller than particle sizes of the second partial amount of the bulk supply of the material;

creating a material bed immediately upstream of the milling gap as a result of oversupplying material, by means of a filled material chute or funnel, whereby the first and the second rollers are able to draw material into the milling gap from a drawing in region;

milling the material by means of applying pressure to the material in the milling gap, between the first and the second rollers of the high-pressure roller mill, to produce the milled product so that particles of the first partial amount of the bulk supply of the material are milled in a packed particle fill in the milling gap while particles of the second partial amount of the bulk supply of the material are milled by contact with both the first and the second rollers; and removing the milled product through the outlet opening.

2. The method as claimed in claim 1, wherein the first roller and the second roller rotate at different speeds.

3. The method as claimed in claim 1, wherein the step of setting the milling gap comprises setting an adjustable damping with reference to a deflection in the direction in which the or each of the at least one of the first and the second rollers is mounted so as to be movable so as to completely suppress any oscillation of the first roller and the second roller with respect to one another.

4. The method as claimed in claim 1, wherein, following the step of milling the material, conveying the milled product into a separating step for separation into finer milled product and coarser milled product.

5. The method as claimed in claim 4, further comprising conveying the coarser milled product back into the feed opening and/or a further high-pressure roller mill is connected downstream of the separating step for further milling of the finer milled product.

6. A miffing method for producing a milled product consisting of at least one of flour and semolina from a material selected from the group of materials consisting of cereals, cocoa, sunflower seeds and rice or combinations thereof, said method including:

providing a high-pressure roller mill comprising:

a feed opening and an outlet opening, a first roller and a second roller, wherein at least one of the first and the second rollers is mounted so as to be movable in a direction substantially perpendicular to a rotational axis of the other of the first and the second rollers, such that a milling gap may be set between the first and the second rollers, providing a bulk supply of the material consisting of particles with a size distribution, wherein a first partial amount of the bulk supply of the material consists of finer material to be milled and a second partial amount of the bulk supply of the material consists of coarser material to be milled;

setting the milling gap in such a manner that, during operation, the first roller and the second roller do not oscillate with respect to one another, wherein the milling gap is set larger than particle sizes of the first partial amount of the bulk supply of the material, and the milling gap is set smaller than particle sizes of the second partial amount of the bulk supply of the material;

feeding the bulk supply of the material to the miffing gap so as to create a material bed immediately upstream of the miffing gap due to an oversupply of the bulk supply of the material to the milling gap, and the first and the second rollers being able to draw material into the milling gap from a drawing in region located immediately adjacent the milling gap and within the material bed;

milling the material by applying pressure to the material located within the milling gap, between the first and the second rollers of the high-pressure roller mill, to produce the milled product so that particles of the first partial amount of the bulk supply of the material are milled in a packed particle fill in the milling gap while particles of the second partial amount of the bulk supply of the material are milled by contact with both the first and the second rollers; and removing the milled product through the outlet opening.

* * * * *